US010814937B2

(12) United States Patent
Schmidt

(10) Patent No.: US 10,814,937 B2
(45) Date of Patent: Oct. 27, 2020

(54) PROTECTIVE COVER FOR SAIL CONNECTORS

(71) Applicant: Linear Market Technical Services Corporation, Pottstown, PA (US)

(72) Inventor: Thomas Donald Schmidt, Pottstown, PA (US)

(73) Assignee: Linear Market Technical Services Corporation, Pottstown, PA (US)

( * ) Notice: Subject to any disclaimer, the term of this patent is extended or adjusted under 35 U.S.C. 154(b) by 0 days.

(21) Appl. No.: 16/210,449

(22) Filed: Dec. 5, 2018

(65) Prior Publication Data

US 2019/0176935 A1 Jun. 13, 2019

Related U.S. Application Data

(60) Provisional application No. 62/597,959, filed on Dec. 13, 2017.

(51) Int. Cl.
*B63B 17/00* (2006.01)
*B63H 9/08* (2006.01)

(52) U.S. Cl.
CPC ..... *B63B 17/00* (2013.01); *B63H 9/08* (2013.01); *B63B 2017/0045* (2013.01); *B63B 2231/00* (2013.01)

(58) Field of Classification Search
CPC ..... B63B 17/00; B63H 9/08
See application file for complete search history.

(56) References Cited

U.S. PATENT DOCUMENTS 4,228,755 A * 10/1980 Graham ..... B63H 9/10 114/111
4,266,495 A * 5/1981 Hood ..... B63H 9/08 114/106
4,741,281 A * 5/1988 Doyle ..... B63H 9/1092 114/102.15
4,817,549 A * 4/1989 Beatman ..... B63B 21/54 114/102.18
5,131,344 A * 7/1992 Noorman ..... B63B 15/0083 114/90
5,562,063 A * 10/1996 Graham ..... B63H 9/08 114/105
6,286,268 B1 * 9/2001 Pena ..... E04B 1/3416 135/119
7,275,491 B1 * 10/2007 Cook ..... B63H 9/1028 114/104
8,826,840 B1 * 9/2014 Slack ..... B63B 15/0083 114/113
2019/0176935 A1 * 6/2019 Schmidt ..... B63B 17/00

* cited by examiner

*Primary Examiner* — S. Joseph Morano
*Assistant Examiner* — Jovon E Hayes
(74) *Attorney, Agent, or Firm* — Wendy W. Koba

(57) ABSTRACT

A connector cover is proposed that protects the web loop portion of a foresail from exposure to UV radiation. The connector cover is formed of UV-resistant material and is configured to include a tab portion that passes through the shackle and a shroud portion that wraps around the tab and web loop in a manner that maintains the cover in place. Various hook-and-loop fasteners can be used to fix the connector cover in place, as well as external ties, cording, or any other suitable type of releasable fasteners. Advantageously, the connector cover is configured to remain in place and provide protection, but is also easy to remove and replace as necessary.

12 Claims, 7 Drawing Sheets

PROTECTIVE COVER FOR SAIL CONNECTORS

CROSS-REFERENCE TO RELATED APPLICATIONS

This application claims the benefit of U.S. Provisional Application No. 62/597,959 filed Dec. 13, 2017 and herein incorporated by reference.

TECHNICAL FIELD

The present relates to maintenance of sails as used on sailboats and, more particularly, to a UV-resistant cover that fits easily through an associated shackle (or other type of attachment) and surrounds the terminating portion of the sail.

BACKGROUND OF THE INVENTION

Foresails on a typical sailboat are held in the hoisted position with a halyard connected by a shackle to the sail head through a grommet, ring or a "web loop" (i.e., a loop of webbing material such as canvas, nylon derivatives, or any other suitable type of strong strapping material).

Many foresails are installed on furling systems and remain on the forestay when not in use. The foresail head web loop (or other types of connectors) can be subjected to many hundreds of pounds of force and is known to be a common cause of failure. The probability of failure increases dramatically as the exposure time to UV rays increases.

SUMMARY OF THE INVENTION

The problems associated with web loop failure are addressed by the present invention which relates to a cover for the web loops and, more particularly, to a UV-resistant cover that fits easily through an associated shackle (or other type of attachment) and surrounds the web loop and adjacent head portion of the foresail itself.

An exemplary embodiment of the present invention takes the form of a flexible, UV-resistant material including a tab portion (formed along one edge thereof) and a shroud portion. The tab portion is sized to pass through a rigging attachment and the shroud portion is sized to cover the threaded tab portion and wrap around the connector portion of the foresail.

Other and further embodiments and features of the present invention will become apparent during the course of the following description and by reference to the related drawings.

BRIEF DESCRIPTION OF THE DRAWINGS

Referring now to the drawings, where like elements have like numerals in several views.

DETAILED DESCRIPTION

Figure 1:
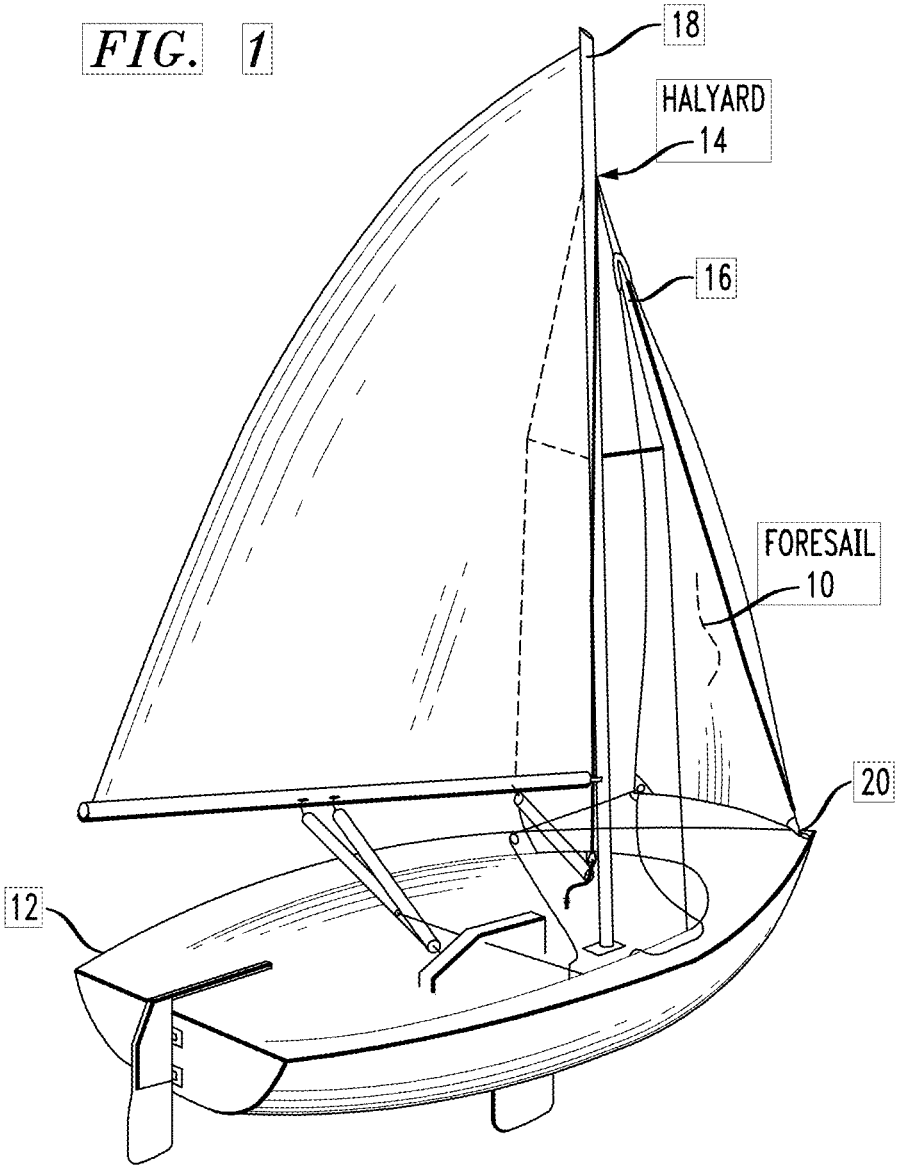
FIG. 1 is a simplified illustration of a sailboat, illustrating the location of an exemplary foresail and its connectors for providing attachment at the head, tack, and yew.
Figure 2:
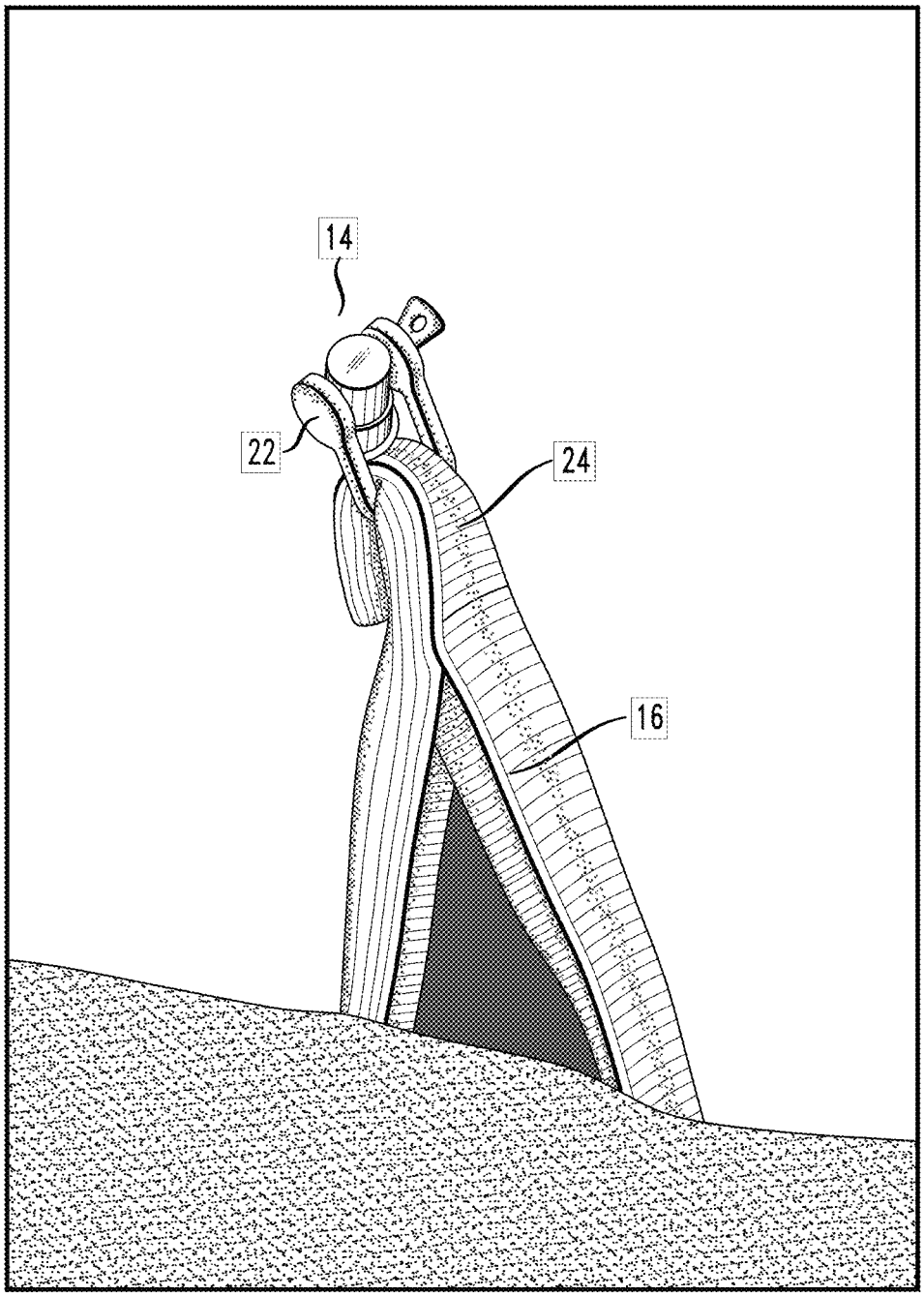
FIG. 2 is an enlargement of an exemplary connection between a shackle of the halyard and a web loop of a foresail.

FIG. 1 illustrates an exemplary foresail 10 in an unfurled position on a sailboat 12. A halyard 14 is used to attach foresail head 16 to mast 18. A tack 20 of foresail 10 is attached to the deck of sailboat 12. In many cases, the attachment between halyard 14 and foresail head 16 is provided by a shackle attached to halyard 14 and a web loop attached to foresail head 16. FIG. 2 illustrates an exemplary shackle 22 and an attached web loop 24. Inasmuch as web loop 24 remains exposed to sunlight (even when the foresail is furled), it will degrade over time as a result of UV exposure.

Figure 7:
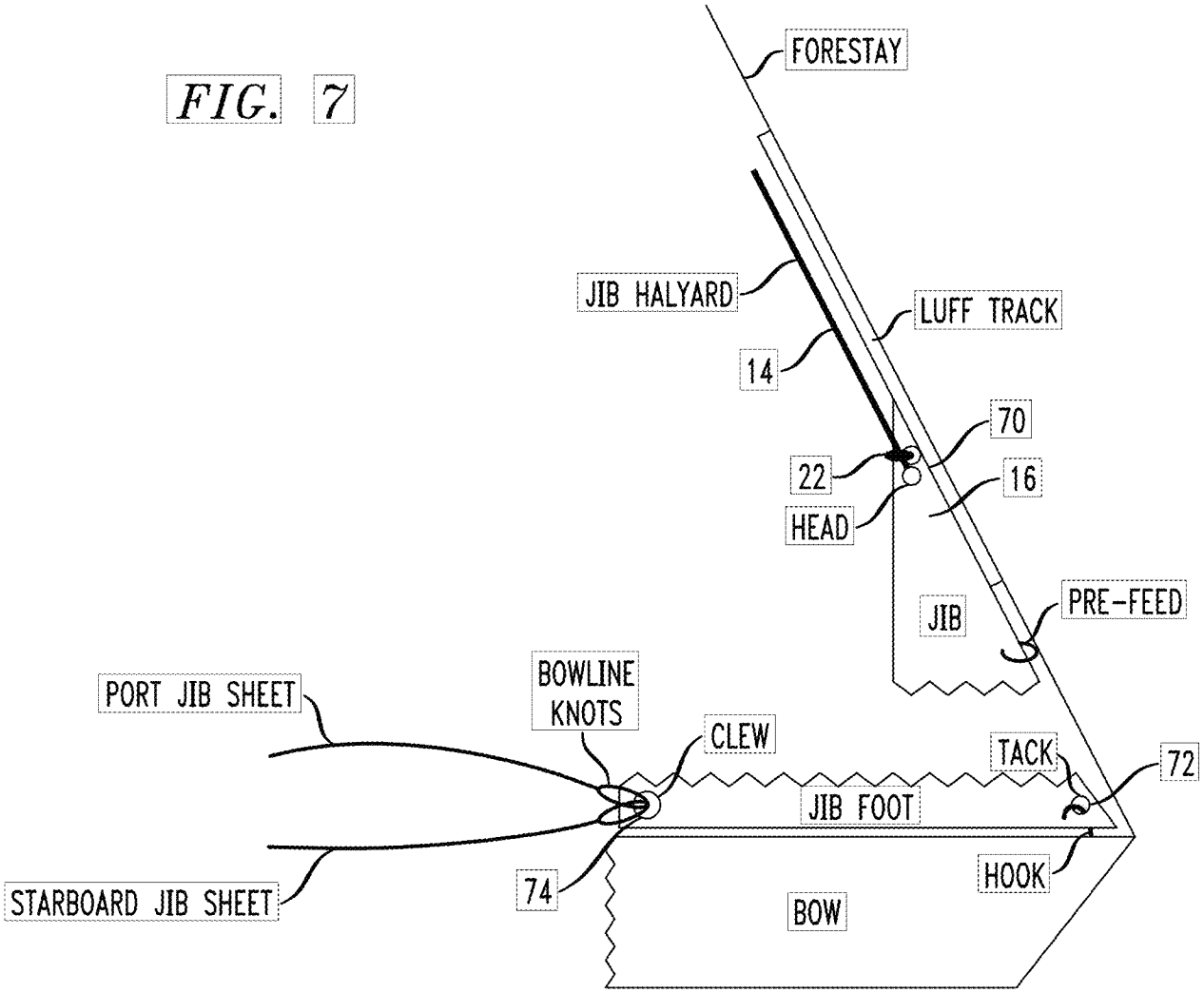
FIG. 7 is a diagram showing the use of a set of grommets for attaching a foresail, with the understanding that the protective cover of the present invention may also be used in embodiments where grommets or ring (instead of web loops) are used as foresail attachment mechanisms.

It is to be understood that while the following discussion describes the use of web loops as connectors at foresail terminations (such as the foresail head), the protective cover of the present invention may be used with any type of termination, such as grommets (as shown in FIG. 7, below), rings, or other fixturing used to attach a foresail head to a halyard or the like.

Figure 3:
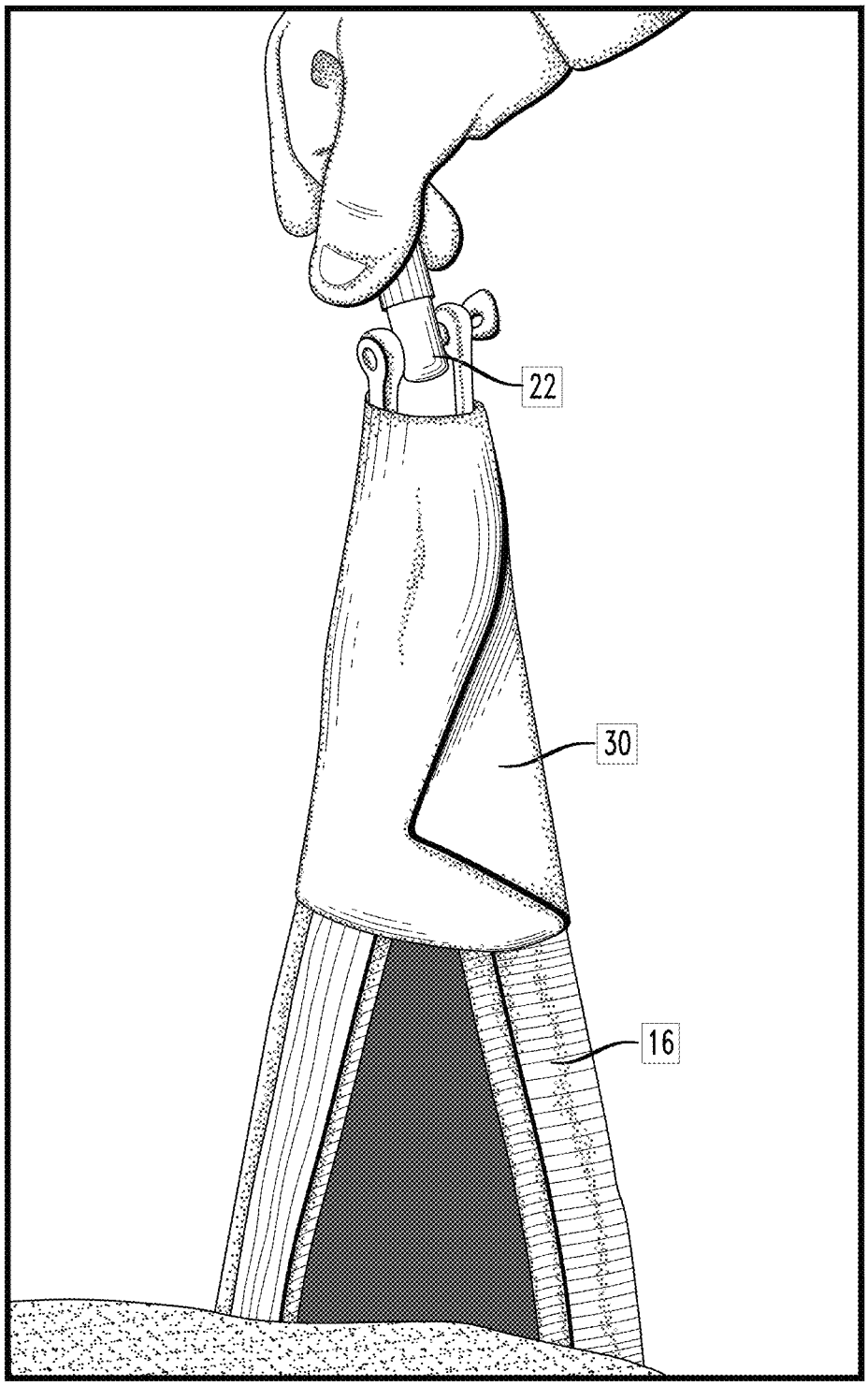
FIG. 3 illustrates an exemplary protective cover of the present invention as disposed in place over the web loop portion of the foresail as shown in FIG. 2.

To address the UV exposure problem, a connector cover is proposed that protects the web loop (or other similar connection mechanism, such as a ring or grommet) from exposure to UV radiation. FIG. 3 illustrates an exemplary connector cover 30 in place over the shackle/web loop combination of FIG. 2. As will be discussed below, connector cover 30 is formed of UV-resistant material and is configured to pass through the shackle and wrap around the web loop (ring, grommet, or the like) in a manner that maintains the cover in place. Various hook-and-loop fasteners can be used to fix connector cover 30 in place, as well as external ties, cording, or any other suitable type of releasable fasteners. Advantageously, connector cover 30 is configured to remain in place and provide protection, but is also easy to remove and replace as necessary. Thus, it is contemplated that connector cover 30 is best described as a "removable protective cover".

Figure 4:
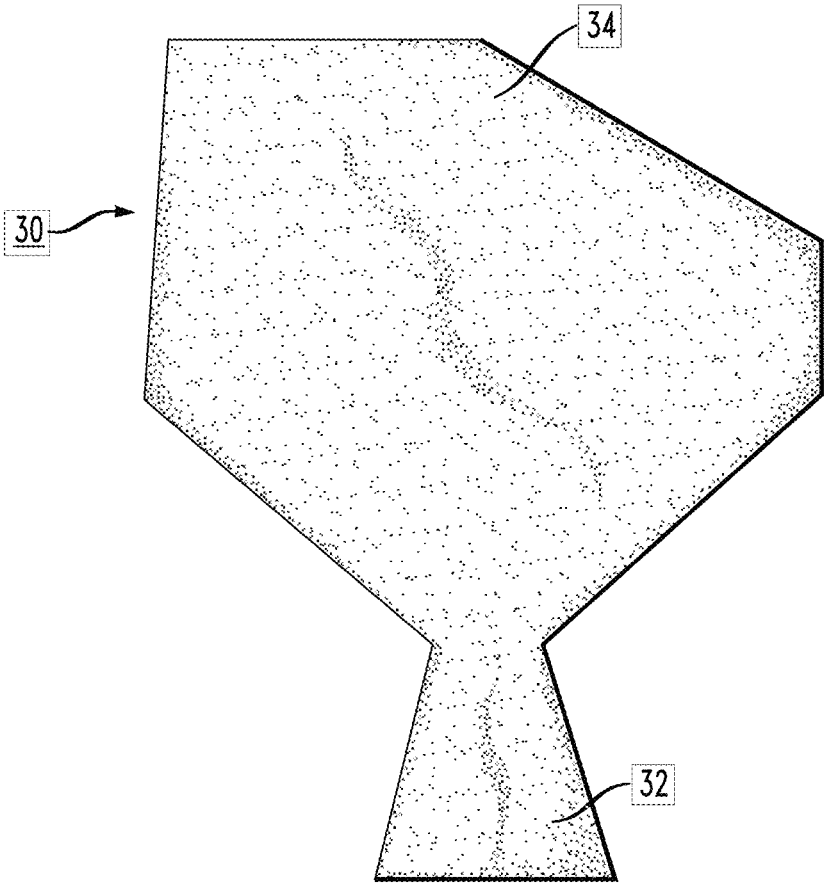
FIG. 4 is a plan view of a protective cover of the present invention, including a tab portion and shroud portion configured from UV-resistant material.

FIG. 4 is a plan view of a connector cover 30, illustrating one exemplary design. As shown, cover 30 includes a tab portion 32 that easily threads through a shackle (or other type of attachment fixture) and a shroud portion 34 that wraps around the terminating portion (e.g., head) of the foresail so as to completely cover and protect the connection mechanism being used (such as web loops, rings, grommets, or the like). Connector cover 30 may be formed of a single piece of UV-resistant material, or various pieces of material joined together.

Figure 5:
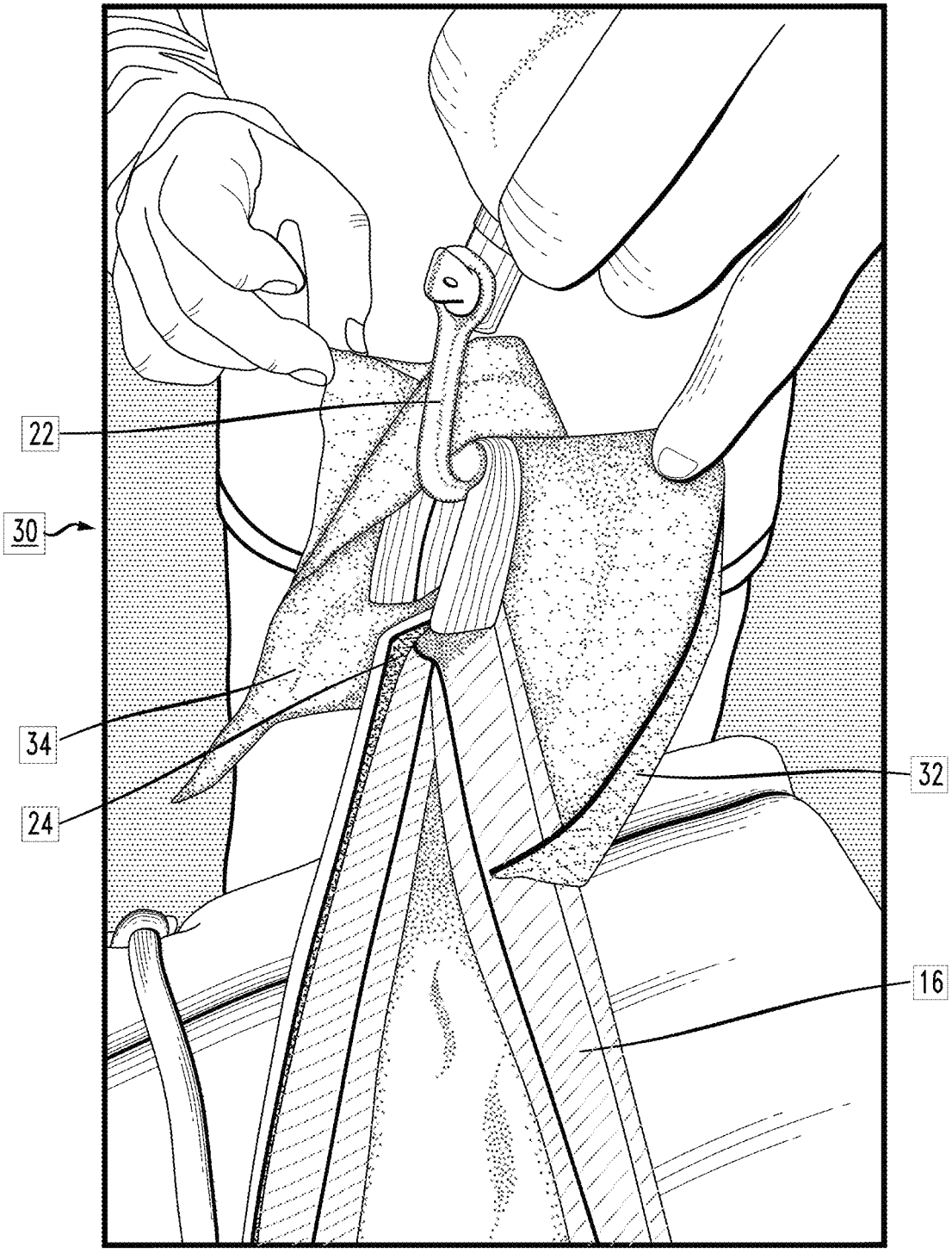
FIG. 5 illustrates a first step of placing the inventive cover over the web loop, in particular threading the tab portion through the shackle of the halyard.
Figure 6:
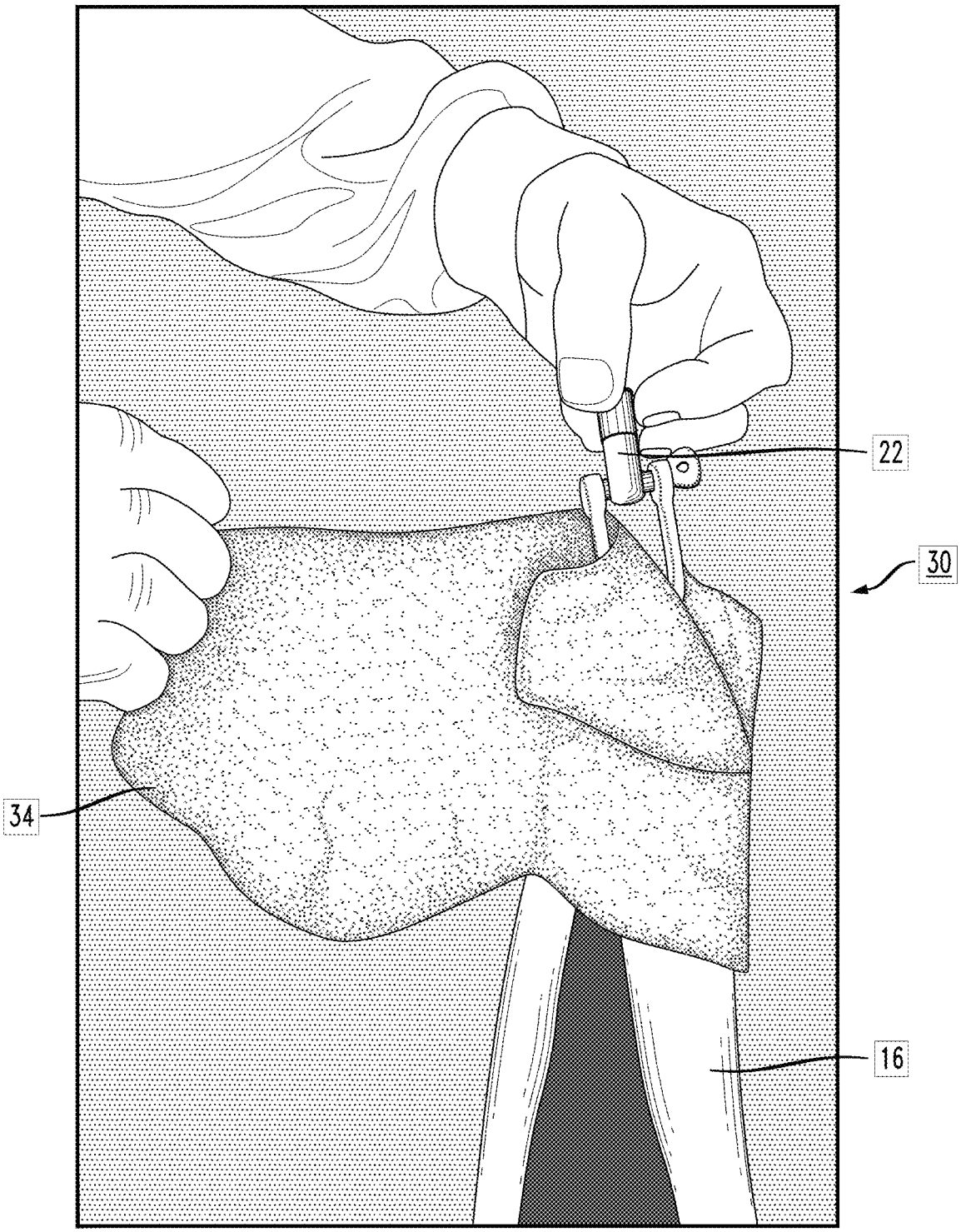
FIG. 6 illustrates a next step of cover placement, including wrapping the shroud portion of the cover over the threaded tab portion and the web loop.

FIG. 5 shows an initial step of passing tab portion 32 through shackle 22, and FIG. 6 shows a following step of wrapping shroud portion 34 around web loop 24. As shown, the act of wrapping shroud portion 34 around web loop 24 also covers tab portion 32 that has been previously threaded through the shackle. In preferred embodiments, shroud portion 32 is formed to exhibit a length L sufficient to fully cover web loop 24 (or any other connector means being used).

While described in association with protecting the web loop attaching foresail head 16 to halyard 14, similar covers may be used with web loops (rings, grommets, or the like) used at the tack and clew locations.

Connector cover 30 may be formed of any appropriate UV-resistant material including, but not limited to, Sunbrella® fabric offered for sale by Sunbrella Fabric, anti-UV vinyl offered for sale by BigZFabric, or the like.

It is to be understood that while connector cover 30 has been described above as protecting a "web loop" used to provide attachment between a foresail and the rigging, cover 30 is also useful in protecting other configurations used to attach a foresail to its rigging. For example, a ring may be substituted for a web loop, providing the same "loop" as the web material. The use of a connector cover formed in accordance with the present invention functions to protect the stitching/binding used to attach the ring (which may be formed of stainless steel) to the foresail.

FIG. 7 illustrates an alternative embedment that uses grommets to attach a foresail at the head, tack, and clew locations. They are shown as grommets 70, 72 and 74, respectively. A protective cover 30 of the present invention may be disposed to cover these grommets and an associated portion of the foresail in the manner described in detail above.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device comprising a flexible, UV-resistant protective cover for enclosing a terminal connector portion of a foresail including a tab portion formed along one edge thereof, the tab portion sized to pass through a rigging attachment of the foresail; and a shroud portion sized to cover the tab portion and wrap around the terminal connector portion of the foresail.

2. The device as defined in claim 1 wherein the protective cover further comprises means for removably fixing the protective cover around the terminal connector portion of the foresail.

3. The device as defined in claim 2 wherein the means for removably fixing the protective cover comprises a separate binding element disposed to surround the shroud portion and hold the protective cover in place.

4. The device as defined in claim 2 wherein the means for removably fixing the protective cover comprises a removable fastening mechanism incorporated on appropriate front and back surfaces of the flexible, UV-resistant material.

5. The device as defined in claim 4 wherein the removable fastening mechanism comprises a hook-and-loop fastening component.

6. The device as defined in claim 1 wherein the terminal connector portion comprises a web loop.

7. The device as defined in claim 6 wherein the shroud portion is sized to completely cover the web loop.

8. The device as defined in claim 1 wherein the terminal connector portion comprises a grommet disposed through a portion of the foresail.

9. The device as defined in claim 8 wherein the shroud portion is sized to completely cover the grommet.

10. The device as defined in claim 1 wherein the terminal connector portion comprises a ring attached to a terminal portion of the foresail using a stitched binding.

11. The device as defined in claim 10 wherein the shroud portion is sized to completely cover at least the stitched binding.

12. The device as defined in claim 1 wherein the protective cover comprises a single piece of UV-resistant material.

* * * * *